US005551836A

United States Patent [19]

Roth et al.

[11] Patent Number: 5,551,836

[45] Date of Patent: Sep. 3, 1996

[54] HIGH PRESSURE COMBUSTION BLOWER ASSEMBLY

[75] Inventors: James E. Roth, St. Charles; Louis H. Zimmermann, both of Elgin, Ill.

[73] Assignee: Revcor, Inc., Carpentersville, Ill.

[21] Appl. No.: 379,356

[22] Filed: Jan. 27, 1995

[51] Int. Cl.[6] ..... F04D 29/44

[52] U.S. Cl. ..... 415/204; 415/206; 415/208.1

[58] Field of Search ..... 415/119, 204, 415/206, 208.1, 211.1

[56] References Cited

U.S. PATENT DOCUMENTS

| | | | |
|---|---|---|---|
| 820,398 | 5/1906 | Davidson | 415/204 |
| 2,290,423 | 7/1942 | Funk | 415/206 |
| 4,549,848 | 10/1985 | Wallman | 415/206 |

FOREIGN PATENT DOCUMENTS

| | | | |
|---|---|---|---|
| 2633781 | 2/1978 | Germany | 415/206 |
| 59-203898 | 11/1984 | Japan | 415/204 |
| 59-200099 | 11/1984 | Japan | 415/204 |
| 2117050 | 10/1983 | United Kingdom | 415/119 |

*Primary Examiner*—Edward K. Look
*Assistant Examiner*—James A. Larson
*Attorney, Agent, or Firm*—Leydig, Voit & Mayer, Ltd.

[57] ABSTRACT

A high pressure blower assembly includes a spiral-type blower housing, impeller wheel and a baffle arrangement disposed proximate the inlet of the blower housing. The baffle arrangement includes a first baffle segment extending from the inlet into the inner periphery of the impeller wheel, a second baffle segment having a generally curved portion that terminates at an apex region located proximate the cut-off point of the blower housing, and a generally curved third baffle segment, disposed proximate the impeller wheel, that joins the second baffle segment.

18 Claims, 6 Drawing Sheets

FIG. 1
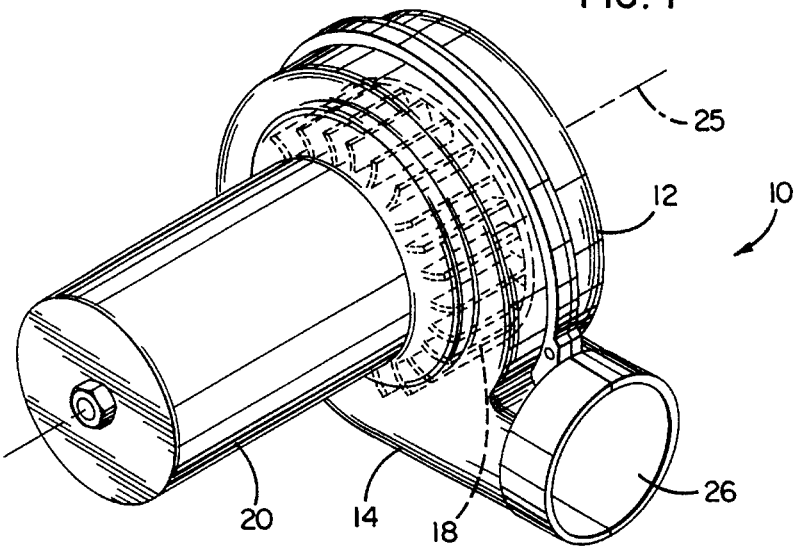
FIG. 2
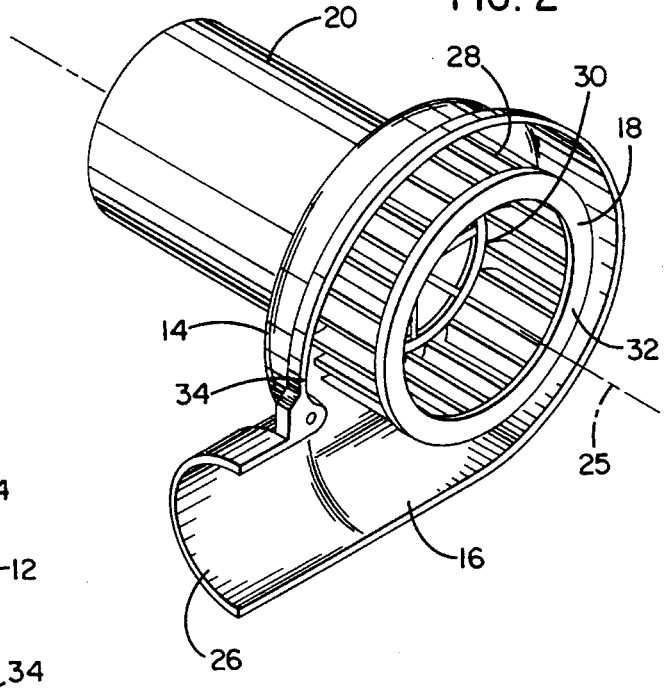
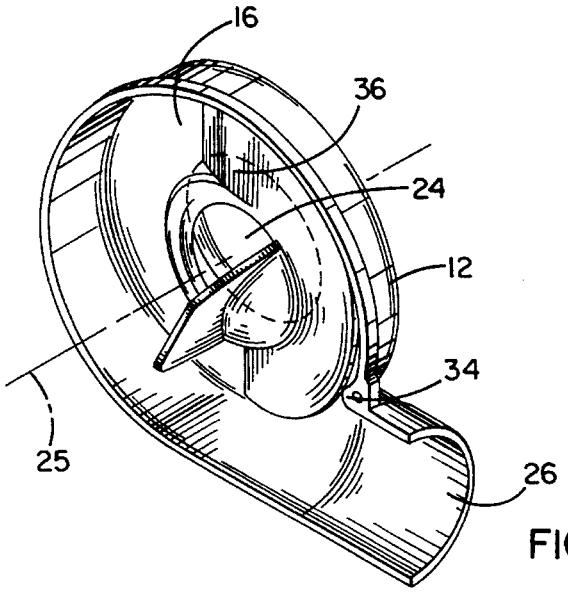
FIG. 3

HIGH PRESSURE COMBUSTION BLOWER ASSEMBLY

FIELD OF THE INVENTION

The present invention relates to the blower art. In particular, the invention relates to an improved baffle arrangement for use in conjunction with an impeller wheel and housing in a high pressure blower assembly. The baffle arrangement of the present invention improves the pressure output of the blower assembly, at a given operating speed, without compromising the power consumption of the assembly.

BACKGROUND OF THE INVENTION

Typically, fossil fuel furnaces and other appliances employ the use of a high pressure combustion blower in order to supply pressurized air to various locations within a heating and ventilation system. These furnaces typically comprise a sealed combustion air system with a blower arrangement at the outlet of the furnace that creates a pressure differential so that a selected amount of air may be directed through secondary heat exchangers and to and from remote vent locations with the use of piping having a relatively small diameter. Accordingly, a constant relatively high air pressure and flow must be maintained for proper mixing and combustion of the fuel air mixture. It is desirable to achieve this goal using a compact blower assembly which is capable of fitting within limited available space, and which operates with a minimum power input to a drive motor.

Inasmuch as the pressure of the blower assembly fan wheel is proportional to the peripheral speed thereof, prior attempts of achieving constant high pressure outputs have increased the diameter of the fan wheel in order to increase the pressure output. Other approaches have utilized blower systems with increased power input in order to boost the speed of the fan wheel. These approaches require increased system cost, and have resulted in problems in installation since all the necessary system components must be fit within limited available space. In addition, the overall system efficiency is reduced due to the increased motor power input.

Other attempts to increase the pressure output in blower assemblies have provided particular baffling arrangements. For example, U.S. Patent 4,549,848 to Wallman describes a curved inlet baffle that is utilized in conjunction with a conventional spiral-type blower housing and fan wheel arrangement. The baffle in this so-called "Swirlwind" arrangement is positioned relative to an axial inlet of the blower housing at an angle less than 90 degrees to the inside surface of the blower housing. In addition, this baffle design includes a straight edge piece located along the side proximate the cutoff point of the blower housing. This design results in a significant undercut which cannot be practically molded as an integral part of the blower surface side surface, thus requiring a multiple piece assembly. Likewise, internal turbulence developed within this arrangement produces objectionable noise levels. Furthermore, these known arrangements are less efficient than the present invention, as is shown in the table in the Detailed Description of the Preferred Embodiment.

SUMMARY OF THE INVENTION

Accordingly, the prior art high pressure blower designs now offer unsatisfactory performance, at high cost with resulting increased noise levels, particularly in fossil fuel furnace systems and other appliances. Likewise, they suffer from difficulties in manufacture and installation. Accordingly, a principle object of the present invention is to generally overcome deficiencies of the prior art.

More particularly, it is an object of the present invention to provide improved pressure output in a blower assembly.

It is an additional object of the present invention to provide a commercial quality blower assembly that improves efficiencies in operation.

It is another object of the present invention to provide reduced noise in a high pressure blower assembly.

It is a particular object of the present invention to provide a baffle arrangement that provides ease of manufacture and installation in a high pressure blower assembly.

The present invention provides these and other additional objects through an improved, high pressure blower assembly. Structurally, a preferred embodiment of the present invention comprises a spiral blower housing including a fluid inlet disposed about a housing axis. The blower housing includes fluid outlet oriented tangentially from the housing axis, and a generally spiral-shaped side wall defining the interior of the housing. The sidewall has a radial dimension that geometrically progresses from a cut-off point to the outlet. The blower assembly includes an impeller wheel disposed about the housing axis, opposite the fluid inlet, that is coupled to a suitable drive source. In operation, the impeller wheel draws air received through the inlet and creates a velocity flow therethrough to provide a desired static pressure at the output.

A baffle arrangement according to the invention includes a first baffle segment or plate extending from the inlet toward the inner periphery of the impeller wheel. A second baffle segment partially circumscribes the first segment and the inlet with a curvature that approximates the inner radial dimension of the blower housing. The second baffle segment includes a ramped or graduated surface that defines an apex region disposed proximate the cutoff point of the housing for controlling the amount of air recirculated from the outlet through the impeller wheel. In a preferred embodiment, the baffle arrangement includes a third baffle segment having a curvature approximating the inner periphery of the impeller wheel that is joined with the first segment and the second segment to define a baffle inlet. The third segment also includes a raised section proximate to the baffle segment that shields at least a portion of the inlet air from the recirculating air, which has a positive pressure relative to the inlet air. In operation, the baffle arrangement increases the static pressure and efficiency of the assembly while providing acceptable noise levels. The baffle arrangement according to one preferred embodiment is a unitary piece fabricated of molded plastic which can be easily installed or retrofitted into an existing blower assembly.

BRIEF DESCRIPTION OF THE DRAWINGS

The above described and additional objects and features of the present invention may be further understood by reference to the following detailed description of the preferred embodiment taken in conjunction with the accompanying drawings of which:

FIG. 1 is an isometric view of a typical blower assembly that is suitable for use in conjunction with the present invention;

FIG. 2 is an additional isometric view of the blower assembly of FIG. 1, looking from the other side, with a portion of the assembly housing removed;

FIG. 3 is isometric view of the blower assembly of FIG. 1, with another housing portion of the assembly removed, that illustrates a baffle piece according to the present invention;

Figure 4:
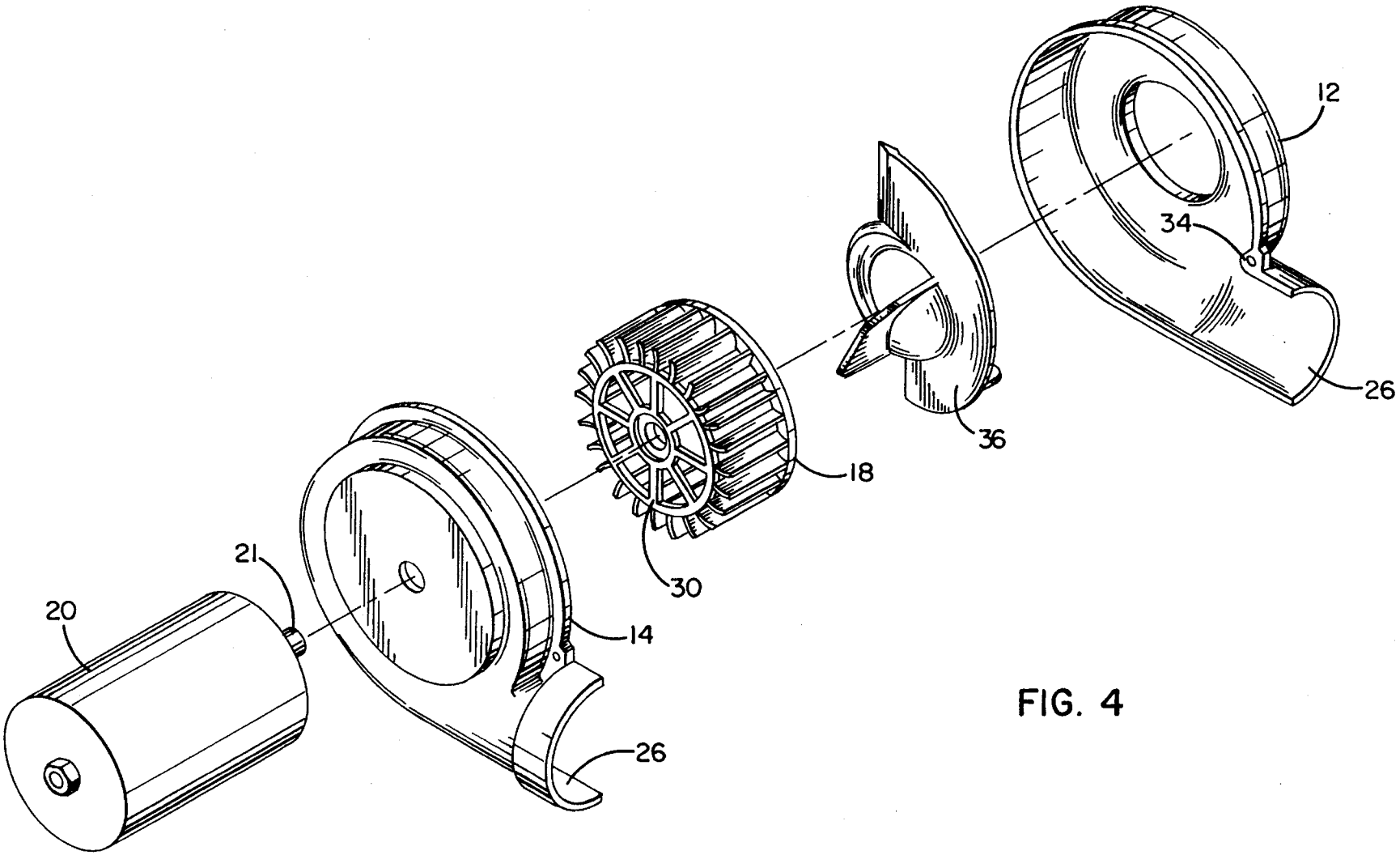
FIG. 4 is an exploded view of the blower assembly of FIG. 1.

It should be understood that the drawings are not necessarily to scale. In certain instances, details which are not necessary for an understanding of the invention may have been omitted.

DETAILED DESCRIPTION OF THE PREFERRED EMBODIMENT

Generally, the present invention provides an improved high pressure blower assembly including a spiral-type blower housing, an impeller wheel and a unique baffle arrangement disposed proximate the inlet of the blower housing. The baffle arrangement includes a first baffle segment extending from the inlet toward the inner periphery of the impeller wheel, a second curved baffle segment spaced from the impeller wheel that is contoured to form an apex region located proximate the cut-off point of the blower housing. In addition, the baffle arrangement includes a generally curved third baffle segment, disposed proximate the inner periphery of the impeller wheel, that joins the first and second baffle segments to provide a generally D-shaped opening at the inlet. In accordance with the present invention, this baffle arrangement provides improved pressure output while increasing the operating efficiency of the blower assembly. The present invention has one particular use in fossil fuel type heating appliances. The invention, however, may also be utilized in any application requiring a relatively high constant pressure blower with a relatively low volume of air.

Referring now to FIG. 1, therein is shown an isometric view of a preferred embodiment of a blower assembly 10 according to the present invention. The blower assembly 10 comprises first and second housing pieces 12 and 14 that form a generally spiral-shaped interior wall surface 16. FIG. 1 also shows an impeller wheel 18, disposed about axis 25, coupled with an electric motor 20 via a drive shaft 21 (see FIG. 4). While opposed housing pieces 12 and 14 are shown as symmetrical pieces, those skilled in the art will appreciate that the housing may be fabricated of other housing piece geometries as well. The motor 20 is mounted to the second housing piece 14 in this embodiment. The blower assembly 10 creates a negative pressure to draw air at an inlet 24 (see FIG. 3) disposed about axis 25 and provides a static pressure at an outlet 26. The geometry of housing pieces 12 and 14, as well as impeller wheel 18 and motor are conventional in the art to which this invention pertains.

FIG. 2 is another isometric view of the blower assembly of FIG. 1, looking the other way, of the second housing piece 14 with the impeller wheel 18 disposed therein. In the preferred embodiment, the wheel 18 includes a plurality of spaced blades 28 each of which has a slight curvature and is secured, at one end, to a hub arrangement 30. At the other end, the blades 28 are secured to a rim 32. The impeller wheel 28 induces flow by drawing air received through the inlet 24 and, as a result of vortexes created between the wheel blades 28, generates a velocity flow therethrough. The velocity flow is converted to static pressure at the outlet 26.

Figure 5:
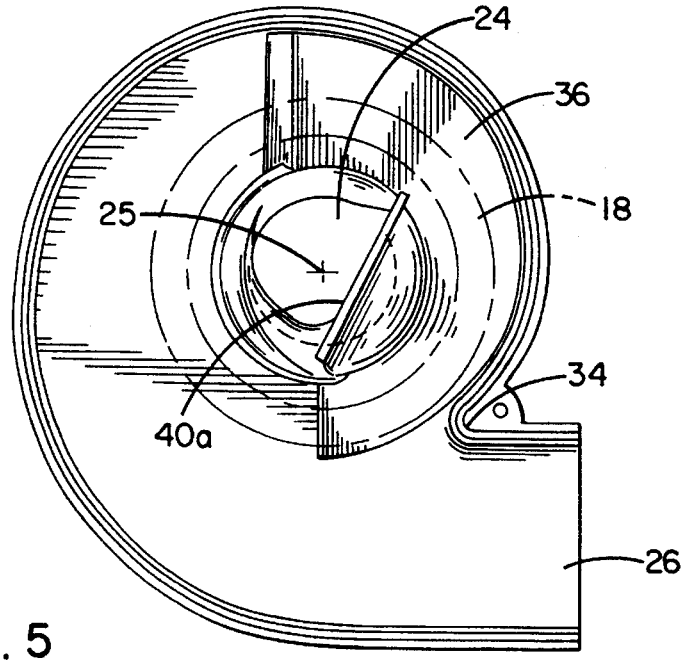
FIG. 5 is a sectional view of a first section of the blower assembly of FIG. 1.
Figure 6:
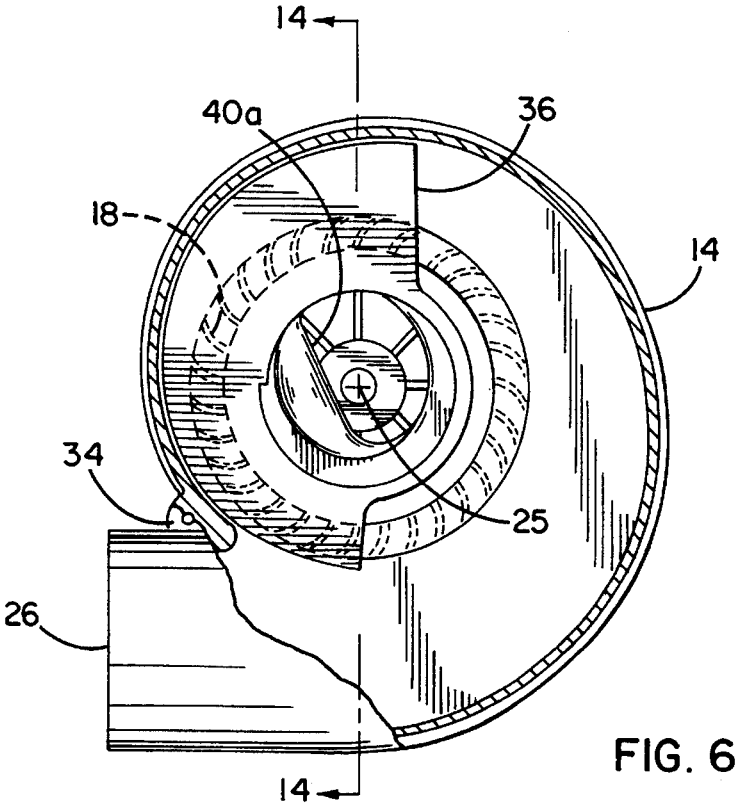
FIG. 6 is sectional view of a second blower section of the assembly of FIG. 1.

FIG. 2, and also FIGS. 5 and 6, illustrate the geometry of the interior wall surface 16. The wall surface 16 provides a cut-off point 34 where the housing angles slightly inward proximate the outlet 26. The wall surface 16 has a radial dimension that progresses from a minimum at the cut-off 34 of the blower housing to a maximum at the outlet 26.

FIG. 3 is an isometric view of the first housing piece 12 with a baffle arrangement 36 according to the present invention. As described in greater detail below, the baffle arrangement 36 increases the static pressure supplied at outlet 26, without increase in power input, to provide improved efficiency in the blower assembly 10.

FIG. 4 is an exploded view that illustrates the main components of the blower assembly in greater detail. As noted above, the baffle arrangement 36 is preferably secured to the first housing piece 12. In other embodiments, the baffle arrangement 36 is fabricated as an integral part of the housing. Likewise, the electrical motor 20 is also preferably secured to the second housing piece 14, but it may be remote from the housing as well. The drive shaft 21 of motor 20 is coupled with the hub of the impeller wheel 18 so that when it is installed in its intended position within the housing, such as when the first and second housing pieces are joined, the baffle arrangement 36 has a portion that extends within the inner periphery of the impeller wheel 18.

Figure 7:
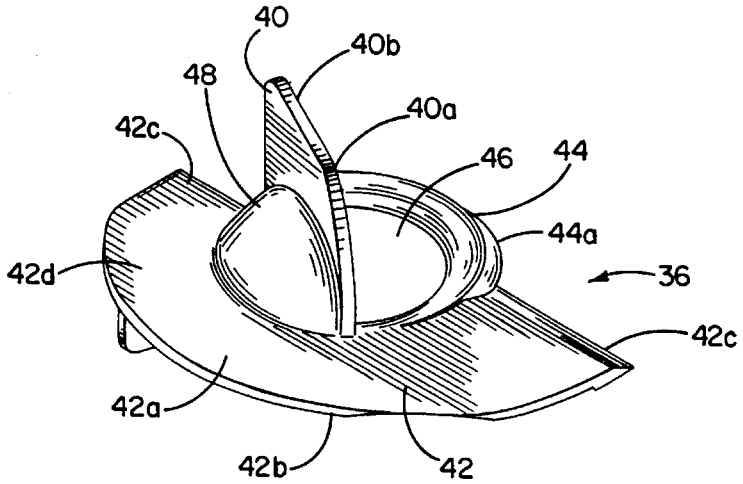
FIG. 7 is an isometric view of the baffle piece of the present invention.
Figure 8:
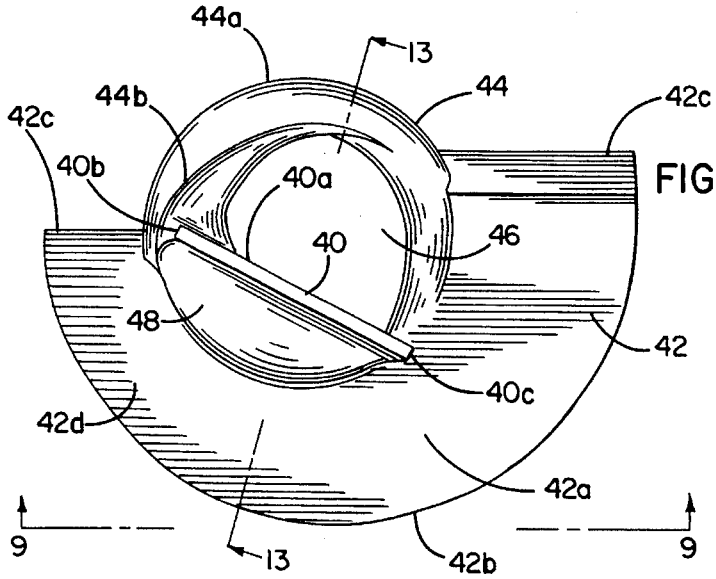
FIG. 8 is a plan view of the baffle piece of FIG. 7.
Figure 10:
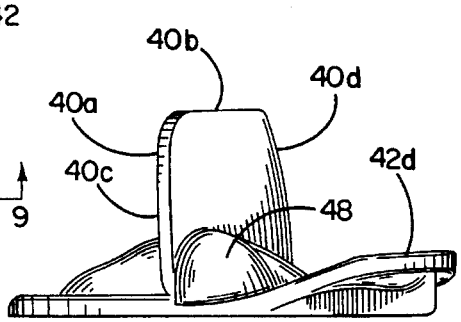
FIG. 10 is sectional view of the baffle piece of FIG. 9 taken along the lines 10—10.
Figure 9:
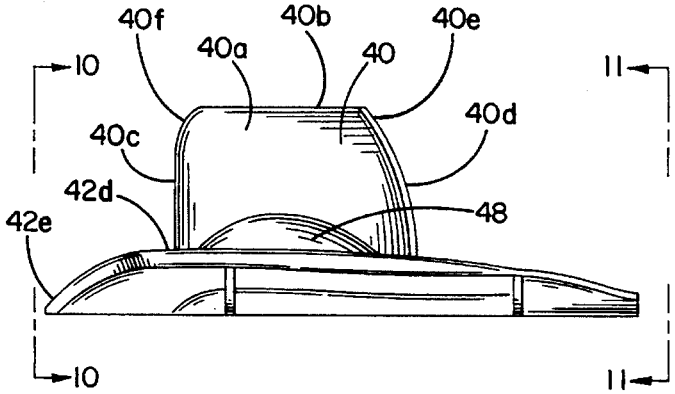
FIG. 9 is a sectional view of the baffle of FIG. 8 taken along the lines 9—9.
Figure 11:
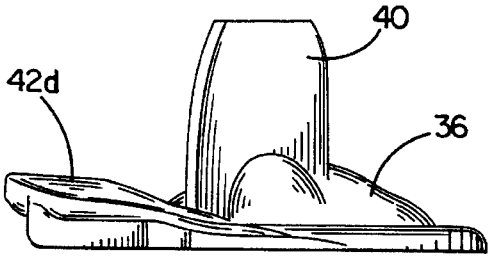
FIG. 11 is another sectional view of the baffle piece of FIG. 9 taken along the lines 11—11.
Figure 12:
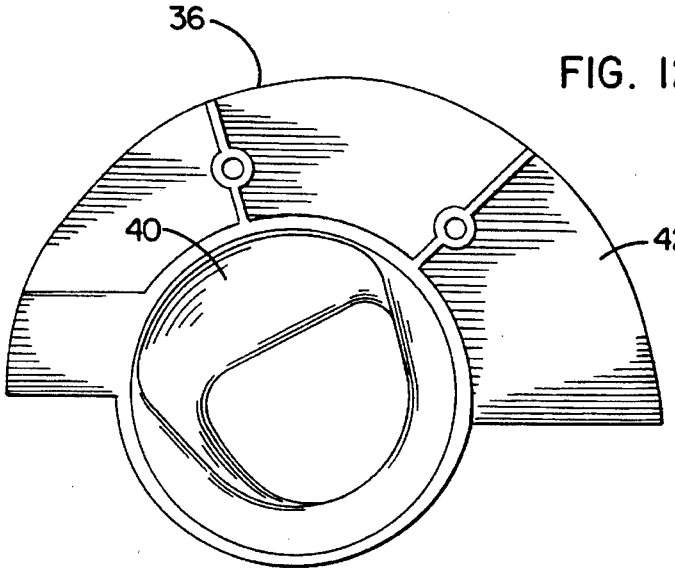
FIG. 12 is a plan view of the baffle piece of FIG. 7, looking from the bottom.
Figure 13:
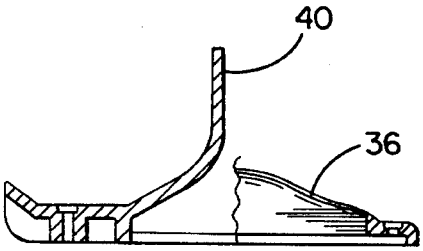
FIG. 13 is a sectional view of the baffle piece taken along the lines 13—13 of FIG. 8.

The main structural details of the baffle arrangement are shown in FIGS. 7 through 13. As shown in FIG. 7 and also FIG. 8, the baffle arrangement 36 comprises a first baffle segment 40 which directs the air received from the inlet 24 toward the inner periphery of the impeller wheel 18. In the preferred embodiment, the first baffle segment 40 is substantially planar and is oriented such that its front surface **40*a* faces opposite the cutoff 34 of the blower housing (see FIGS. 5 and 6). As best seen in FIG. 9, the first baffle segment has an end 40*b*, a generally straight side 40*c* and a somewhat curved side 40*d*. In the preferred embodiment, the radius of curvature of the corner 40*e* joining the end 40*b* with side 40*d* is somewhat larger than the radius of curvature of the corner 40*f* joining the straight side 40*c* with end 40*b***.

The baffle segment 40 is oriented at a selected angle with respect to the outlet portion of the housing, where the recirculating air is at its greatest pressure. This prevents inefficiencies in the blower due to turbulence which would be created by the introduction of the inlet air with recirculating air (which has a positive pressure relative to the inlet air).

A second baffle segment 42 partially surrounds the first baffle segment 40 and has a face surface 42*a* extending between the inner periphery of the impeller wheel rim 32 and the edge of the housing. The second baffle segment 42 has an outer periphery 42*b* that approximates the radial dimension of the blower housing and is preferably contoured to conform with the blower housing. The second baffle segment face surface 42*a* is gradually sloped and ascends from one end 42*c* of the segment to a raised area apex region 42*d*. The face surface 42*a* is also graduated from the other end 42*e* to the apex region 42*d*. This configuration controls the gap on the underside of the impeller wheel 18. Accordingly, a wrap effect is created that controls the amount of air recirculated through the impeller wheel 18 along the face surface 42*a* from the outlet 26 of the blower housing where maximum static pressure is generated.

The baffle arrangement also includes a third baffle segment 44 that joins the second baffle segment 42 proximate the second segment end 42*c* with the opposed second segment end 42*e*. The third baffle segment 44 has an outer surface 44*a* that is generally rounded to conform with the inner periphery of the impeller wheel 18. The third baffle segment also includes a graduated lip section 44*b* that originates opposite the first baffle segment 40 and is contoured with an increasing vertical dimension toward its termination adjacent to first baffle segment end 40*b*. As shown in FIG. 8, the third baffle segment 44 also joins the first baffle segment end 40*b* near its joinder with the second baffle segment end 42*c*. These baffle segments define a generally D-shaped opening 46 to direct air from the inlet toward the impeller wheel.

The contour of the lip section 44*b* also controls the amount of inlet air that is introduced with recirculated air at or proximate the outlet 26. Thus, in other embodiments, the length of the lip section 44*b* may be increased such that it has an increased vertical dimension continuing toward the second segment end 42*c* to further boost the resulting pressure provided at the outlet. Likewise, the first baffle piece 40 may be rotated slightly to permit a greater amount of air to recirculate.

The baffle arrangement also includes a fourth bulged baffle segment 48 that joins the first segment 40 with the second segment 42. The fourth baffle segment 48 is also contoured to evenly distribute the air circulated behind the first baffle segment 40 toward the impeller wheel 18. The geometry of this segment provides a choke to limit the volume of recirculated air. In addition, it permits the baffle opening on the inlet side to be increased where an increased volume is desired.

In one preferred embodiment, the baffle arrangement 36 is a unitary, one-piece plastic construction that may be fabricated by injection molding. Accordingly, the baffle arrangement may be easily installed into existing blower assemblies of varying sizes with appropriate modification. Alternatively, the baffle arrangement may be molded with the housing as an integral structure. Those skilled in the art will appreciate that the present invention may also be manufactured from metal or other suitable materials for higher temperature applications.

Figure 14:
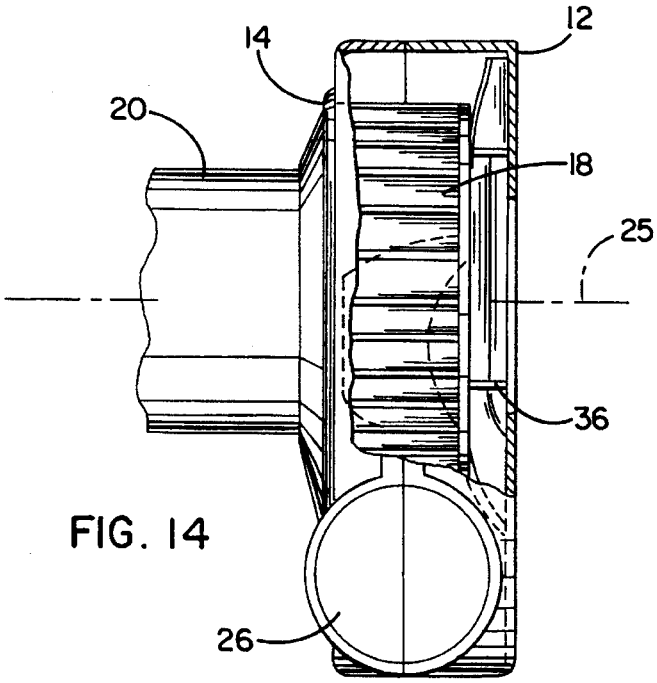
FIG. 14 is a sectional view of the blower assembly of FIG. 6 taken along the lines 14—14.

In operation, the baffle arrangement generally shields the negative pressure at the inlet from positive pressure recirculating air to create a more even flow from the inlet to exhaust. In addition, the arrangement gradually pinches the air off circulated by the impeller wheel 18 at or near the cut-off point, as seen in FIGS. 5 and 6, and also FIG. 14. As shown therein, the first baffle segment 40 extends substantially within the inner periphery blower wheel 18. The surfaces of the baffle arrangement are contoured to eliminate turbulence and provide an even airflow through the impeller wheel and the interior of the housing. As noted above, the pressure output may be further enhanced by one or more of the following: (1) orientation of the baffle arrangement with respect to the outlet through rotation of the first baffle piece to permit more recirculating flow through the wheel; (2) shielding a greater portion of recirculating air from the inlet; or (3) adjustment of the inlet opening.

As set forth above, an improved high pressure blower assembly and baffle arrangement for use in that assembly have been described. Various modifications as would be apparent to one of ordinary skill in the art and familiar with the teaching of this application are deemed to be within the scope of this invention. The precise scope of the invention is set forth in the appended claims, which are made, by reference, are part of this disclosure.

Figure 15:
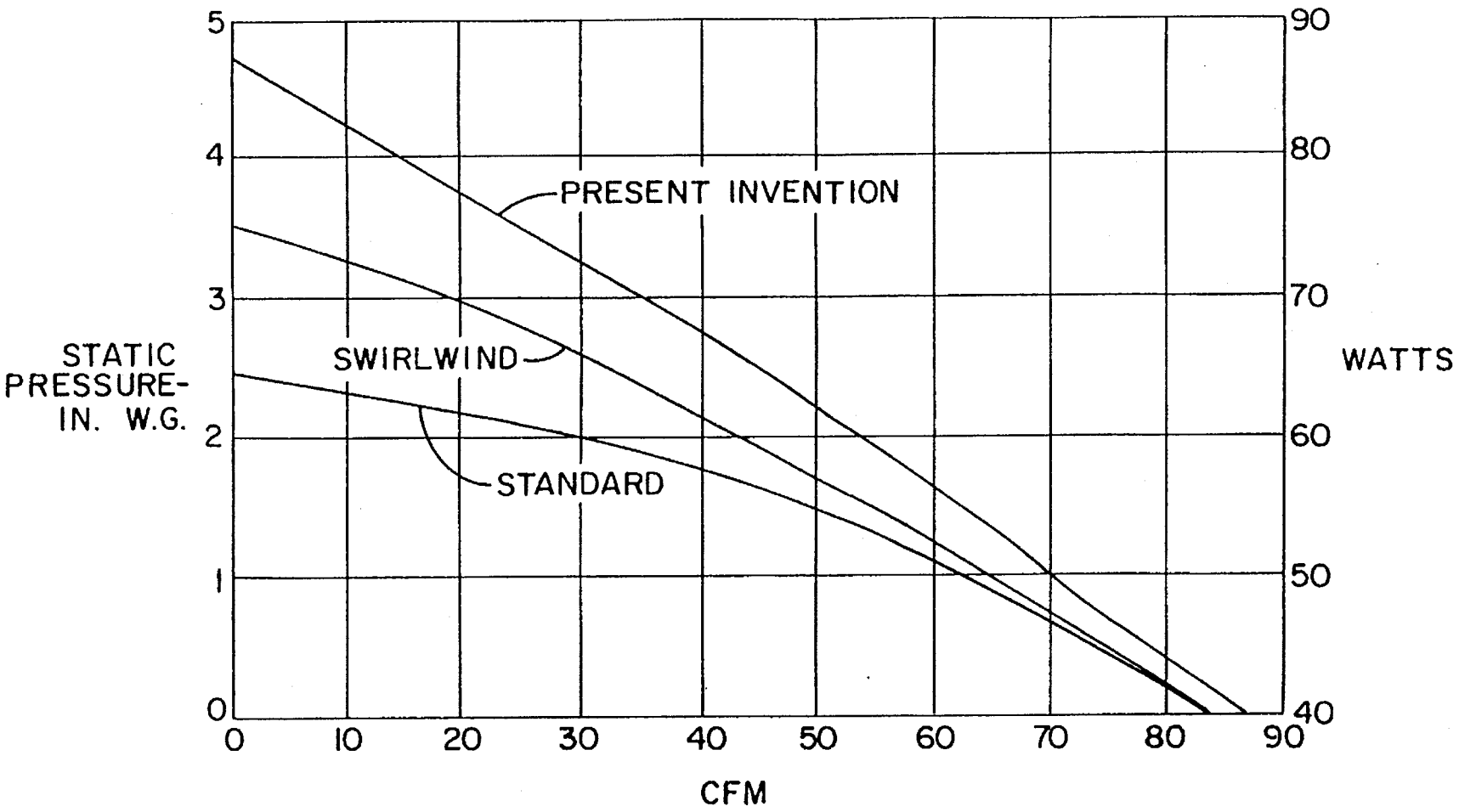
FIG. 15 is a graphical representation of output static pressure as a function of power input for various blower designs including the present invention.

Various advantages flow readily from the disclosed blower assembly and the corresponding baffle arrangement for use in that assembly. For example, a dramatic increase in the static pressure supplied by the blower assembly is realized. In addition, the invention provides a much more efficient arrangement than in the prior art, as is shown in the table at FIG. 15.

Thus, for example, where prior baffle designs may provide a static pressure of 3.5–3.75 inches of water column pressure at a given power input, the present invention provides 5.5–6 inches of water column pressure at the same power input. Likewise, this arrangement provides reduced noise in the blower assembly during operation.

Accordingly, both the structure of the blower housing and the baffle arrangement for use in that housing according to the present invention provides significant improvements over the prior art, improvements that are manifested both in increased performance and diminished cost.

What is claimed is:

1. A high pressure blower assembly comprising:

a scroll-shaped blower housing including an inlet located about a housing axis, an outlet oriented tangentially from the housing axis, a cut-off point disposed proximate the outlet, and a generally spiral shaped sidewall defining an interior of the housing;

an impeller wheel disposed within the housing, coupled to a drive aligned with the housing axis, and including an inner periphery portion; and a baffle piece including a first segment having a first surface defined by an end and a pair of sides and extending from the inlet toward the inner periphery of the impeller wheel, a second baffle segment having a first end, a second end, and an apex region disposed proximate the cut-off point of the housing that controls the amount of fluid recirculated through the housing, the second baffle segment including at least one gradually contoured surface joining the first end with the apex region disposed to direct recirculated fluid therealong, and a third segment having a curvature approximating the inner periphery of the impeller wheel, the third segment joining the first and second ends of the second baffle segment, and together with the first and second baffle segments, defining an opening to receive pressurized fluid from the inlet and pass the pressurized fluid to the impeller wheel.

2. The invention as in claim 1 further comprising a fourth baffle segment, adjoining the first baffle segment and the second baffle segment opposite the baffle opening, comprising a bulged portion intermediate the sides of the first baffle segment for generating an even air distribution opposite the first surface of the first baffle segment toward the impeller wheel.

3. The invention as in claim 1 wherein the third baffle segment includes a lip section originating opposite the first baffle segment.

4. The invention as in claim 1 wherein the baffle opening is generally D-shaped.

5. The invention as in claim 1 wherein the baffle piece is a unitary, one-piece construction.

6. The invention as in claim 1 wherein the at least one gradually contoured surface slopes upwardly from said first end to the apex region.

7. The invention as in claim 1 further including a second gradually contoured surface joining the second end with the apex region.

8. The invention as in claim 7 wherein the second gradually contoured surface slopes upwardly from said second end to the apex region.

9. A baffle for use in a high pressure blower assembly including a scroll-type blower housing and a driven impeller wheel, the housing having an inlet located about a housing axis, an outlet oriented tangentially from the housing axis, a cut-off point disposed proximate the outlet, and a generally spiral shaped sidewall defining an interior of the housing, the impeller wheel disposed within the housing, coupled to a drive aligned with the housing axis and including an inner periphery portion, the baffle comprising:

a first baffle segment having an end and a pair of sides and extending from the inlet at least partially toward the inner periphery of the impeller wheel, a second baffle segment having a radial dimension approximating the sidewall of the blower housing and a facing surface contoured from an end opposite the cut-off point of the blower housing to an apex region proximate the cut-off point and a third segment having a curvature approximating the inner periphery of the impeller wheel which joins the first and second baffle segments and defines an opening to receive pressurized air from the inlet and pass the pressurized air through the impeller wheel to generate a desired static pressure at the outlet.

10. The invention as in claim 9 further comprising a fourth baffle segment, adjoining the first baffle segment and the second baffle segment opposite the baffle opening, including a bulged portion intermediate the sides of the first baffle segment.

11. The invention as in claim 9 wherein the third baffle segment includes a lip section originating opposite the first baffle segment having at least a portion thereof extending into the inner periphery of the impeller wheel.

12. The invention as in claim 9 wherein the baffle opening is generally D-shaped.

13. The invention as in claim 9 wherein the baffle is a unitary, one-piece construction.

14. A high pressure blower assembly comprising:

a scroll-shaped blower housing including an inlet located about a housing axis, an outlet oriented tangentially from the housing axis, a cut-off point disposed proximate the outlet, opposed end walls, and a generally spiral shaped sidewall joined with the end walls to define an interior of the housing;

an impeller wheel disposed within the housing, coupled to a rotary drive axially aligned with the housing axis, and including an inner periphery portion; and a baffle construction including a first segment having a facing surface extending from the inlet toward the inner periphery of the impeller wheel, a second baffle segment having a first end, a second end, and an apex region disposed proximate the cut-off point of the housing that controls the amount of fluid recirculated through the housing, the second baffle segment at least partially circumscribing the first baffle segment and including a first ramped surface joining the first end with the apex region and a second ramped surface joining the second end with the apex region, the second baffle segment disposed to gradually pinch recirculated fluid at or near the cut-off point of the housing.

15. The invention as in claim 14 wherein the second baffle segment is gradually contoured from said first end to the apex region.

16. The invention as in claim 15 wherein the second baffle segment is gradually contoured from said second end to the apex region.

17. The invention as in claim 14 wherein said baffle construction further includes a third baffle segment having a curvature approximating the inner periphery of the impeller wheel, the third segment joining the first and second ends of the second baffle segment, and together with the first and second baffle segments, defining an opening to receive pressurized fluid from the inlet and pass the pressurized fluid to the impeller wheel.

18. The invention as in claim 17 wherein the first segment is defined by a pair of sides, wherein said baffle construction further includes a fourth baffle segment, adjoining the first baffle segment and the second baffle segment opposite the baffle opening, said fourth baffle segment comprising a bulged portion intermediate the sides of the first baffle segment for generating an even air distribution opposite the facing surface of the first baffle segment.

* * * * *